US006056520A

United States Patent [19]

Nguyen et al.

[11] Patent Number: 6,056,520

[45] Date of Patent: May 2, 2000

[54] MAGNETIC DRIVE PUMP HAVING ENCASED MAGNETS FOR PUMPING VERY LOW TEMPERATURE FLUIDS

[75] Inventors: Dan Dinh Nguyen; Gary A. Templin, both of Houston, Tex.

[73] Assignee: Chemical Seal & Packing, Inc., Houston, Tex.

[21] Appl. No.: 09/110,584

[22] Filed: Jul. 6, 1998

Related U.S. Application Data

[62] Division of application No. 08/566,919, Dec. 4, 1995.

[51] Int. Cl.[7] ..... F04B 17/00

[52] U.S. Cl. ..... 417/420; 417/423.12

[58] Field of Search ..... 417/420, 423.12, 417/901; 415/229, 111

[56] References Cited

U.S. PATENT DOCUMENTS

| | | | |
|---|---|---|---|
| 4,531,372 | 7/1985 | Slabaugh | 62/55.5 |
| 4,578,956 | 4/1986 | Young | 62/6 |
| 4,667,477 | 5/1987 | Matsuda et al. | 417/901 |
| 4,680,936 | 7/1987 | Sarwinski et al. | 62/45 |
| 4,722,661 | 2/1988 | Mizuon | 417/360 |
| 4,813,342 | 3/1989 | Schneider et al. | 92/207 |
| 4,849,017 | 7/1989 | Sahasi et al. | 75/245 |
| 4,850,818 | 7/1989 | Kotera | 417/366 |
| 4,997,297 | 3/1991 | Blount | 384/585 |
| 5,017,102 | 5/1991 | Shimaguchi et al. | 417/420 |
| 5,207,981 | 5/1993 | Hanaue et al. | 420/416 |
| 5,209,652 | 5/1993 | Fischer et al. | 417/409 |
| 5,230,570 | 7/1993 | Bursey, Jr. et al. | 384/527 |
| 5,248,245 | 9/1993 | Behnke et al. | 417/366 |
| 5,263,829 | 11/1993 | Gergets | 417/420 |
| 5,291,739 | 3/1994 | Woods et al. | 62/48.1 |
| 5,317,879 | 6/1994 | Goldberg et al. | 62/51.1 |

*Primary Examiner*—Henry Bennett
*Assistant Examiner*—Derek S. Boles
*Attorney, Agent, or Firm*—Gardere & Wynne LLP; John W. Montgomery

[57] ABSTRACT

A seal-less, magnetic drive pump for pumping fluids at very low temperatures such as liquid nitrogen and liquefied natural gas (LNG). The pump includes a housing having an intake and exhaust with a back plate mounted therein in which a shaft is journaled. An impeller is mounted on the first end and a first magnet is mounted on the second end of the shaft. A second magnet is positioned so as to rotate around the first magnet to rotate the impeller. The first magnet is encased in a material having a coefficient of thermal expansion greater than that of the magnetic material.

9 Claims, 2 Drawing Sheets

MAGNETIC DRIVE PUMP HAVING ENCASED MAGNETS FOR PUMPING VERY LOW TEMPERATURE FLUIDS

CROSS-REFERENCE TO RELATED APPLICATIONS

This is a divisional of co-pending and co-owned U.S. application Ser. No. 08/566,919 filed Dec. 4, 1995, incorporated herein by reference and the priority date of which is relied upon for all legitimate purposes herein.

TECHNICAL FIELD OF THE INVENTION

The present invention relates to a pump for use in pumping fluids at very low temperatures. In more detail, the present invention relates to a pump in which the drive source, or motor, is separated from the pump by a housing and is driven by the interaction of first and second magnets acting through the housing for use in pumping fluids at very cold temperatures, for instance, for use in pumping liquefied natural gas (LNG), which has a temperature of about −263° F. (−164° C.).

BACKGROUND OF THE INVENTION

Liquefied natural gas (LNG) and other very low temperature fluids are of increasing commercial importance. There is, therefore, a need for increased facility in handling, storing, and transporting such liquids. For example, LNG is being increasingly utilized as an alternative fuel source for internal combustion engines. Governmental regulations require that LNG be transported at pressures of about 30 psi, but to decrease the amount of LNG that is evaporated or otherwise lost from a storage tank, it is common to store the LNG at pressures of 150 psi. When "bottled" for use as the fuel tank of an internal combustion engine, it is common to pressurize the LNG to pressures as high as 220 psi. Of course each increase in pressure requires that the LNG be pumped into the tank at the next higher pressure such that successful use of LNG as an alternative fuel depends, in effect, upon reliable, safe and energy efficient pumping of high volumes of such fluids.

Pumps are presently available but all suffer from a variety of disadvantages and limitations which limit their life, require frequent maintenance, and otherwise decrease their utility. For instance, many pumps are available for pumping LNG, but so far as is known, the life of all such pumps is limited by the need for frequent maintenance and/or replacement of the seals. Heretofore known seal-less pumps have not provided a satisfactory solution to this problems For instance, magnetic drive pumps are known in the pump art, but their use at very low temperatures is made problematical by the failure of the bonding material utilized on the magnets at that temperature and, in the case of LNG, by the almost complete lack of lubrication that is provided by the LNG passing through the pump.

It is, therefore, an object of the present invention to provide a pump for use at very low temperatures which is not limited by the disadvantages of known pumps. More specifically, it is an object of the present invention to provide a magnetic drive pump for use in pumping at very low temperatures.

Another object of the present invention is to provide a magnetic drive pump useful at temperatures lower than about −100° C.

SUMMARY OF THE INVENTION

These objects, and the advantages, of the present invention are met by providing a magnetic drive pump for use in pumping fluids at very low temperature comprising a back plate having a rotatable shaft journaled therein, an impeller mounted to the first end of the shaft and a first magnet mounted to the second end of the shaft and contained within a casing mounted to the shaft. The casing is comprised of a material having a coefficient of thermal expansion that is greater than the coefficient of thermal expansion of the material comprising the magnet. The back plate is mounted within a housing having openings formed therein for intake of a fluid to be pumped at low pressure and an exhaust for output of the high pressure fluid and a second magnet is positioned in close proximity to the housing for rotation therearound, the second magnet being adapted for mounting to the drive shaft of a motor or other drive source for rotating the second magnet around the housing, thereby rotating the first magnet within the housing to pump the fluid.

BRIEF DESCRIPTION OF THE DRAWINGS

Referring now to the drawings, in

DETAILED DESCRIPTION OF THE PREFERRED EMBODIMENTS

Figure 1:
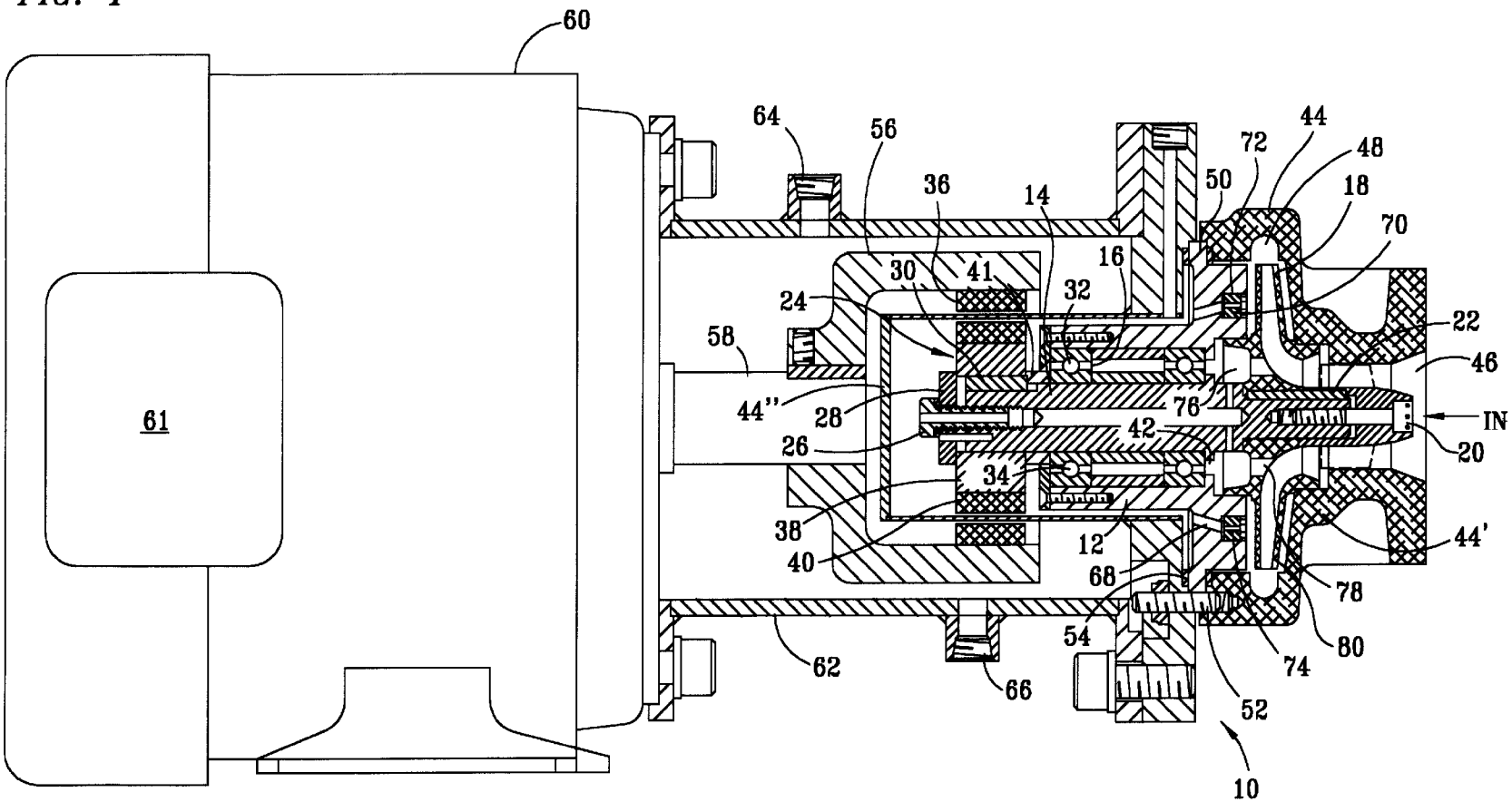
FIG. 1 there is shown a longitudinal sectional view through a preferred embodiment of a pump constructed in accordance with the teachings of the present invention.

A preferred embodiment of a pump constructed in accordance with the present invention will now be described with reference to FIG. 1 of the drawings. That pump, indicated generally at reference numeral 10, is comprised of a back plate 12 having a rotatable shaft 14 journaled in a ball bearing 16 therein. An impeller 18 is mounted to the first end of shaft 14 by a screw 20, a key 22 positioned in the slots (not numbered) on the shaft 14 and impeller 18 preventing relative rotation therebetween. A first magnet 24 is mounted to the second end of shaft 14 by a screw 26 and jam nut 28, the key 30 and slots (not numbered) formed in the second end of the shaft and the magnet 24 preventing relative rotation in the same manner as the key 22 prevents relative rotation between the shaft 14 and impeller 18.

As noted above, one of the objects of the present invention is to provide a seal-less pump which is self-lubricating so as to decrease the need for maintenance of the pump. To that end, the ball bearing 16 is comprised of one or more ball races 32 having balls 34 positioned therein, the ball races 32 and the balls 34 being comprised of a hard, durable material such as heat treated stainless steel.

Also as noted above, a problem arises with the use of magnetic drive pumps as a result of the use of the pump at very cold temperatures in that the material comprising the magnet is unable to withstand the cold temperatures. In more detail, it is the material which bonds (or "pots") the magnetic material 36 comprising the magnet 24 to the carrier 38 which fails at cold temperatures rather than the magnetic material 36 itself. One such material is sold as part of the magnet and carrier assemblies commercially available under the brand name CHEMRX by Ugimag, Inc. (Valparaiso, Ind.). To overcome that limitation of prior art magnetic drive pumps, the magnet 24 of pump 10 is provided with a casing 40 carried on shaft 14 which is trapped between the jam washer 28 and the spacer 41 which traps the ball races 32 against the shoulder 42 formed on shaft 14 and which encases the magnetic material 36. In the preferred embodiment, the casing 40 is comprised of a metallic or other material having a coefficient of thermal expansion which is greater than that of the material 36 comprising the magnet 24 so that, as temperature decreases, the material comprising casing 40 contracts at a rate faster than the rate of contraction of the material 36 comprising the magnet 24 so that the material 36 is held tightly in place on shaft 14.

Back plate 12 is mounted within a housing 44 having openings formed therein for intake and exhaust 46 and 48, respectively, of the fluid to be pumped through pump 10. In the preferred embodiment shown in FIG. 1, the back plate 12 is provided with a flange 50 which is confined between front and back halves 44' and 44" of housing 44 by the screws 52 (only one of which is seen in the view shown in FIG. 1), shoulders (not numbered) being provided for appropriately sized gaskets 54 for sealing the two halves 44' and 44" to the flange 50. The front interior half 44' of housing 44 forms the volute of pump 10.

A second magnet 56 is positioned in close proximity to the housing 44- for rotation therearound and is adapted for mounting to the drive shaft 58 of a motor 60. When the motor 60 is operated, the first magnet 24 within the housing 44 is rotated under the influence of second magnet 56 to drive the impeller 18.

In a preferred embodiment, a frequency inverter 61 is used with the pump to increase the speed of the pump from the maximum standard of 3600 rpm to about 7200 rpm instead of pulleys and a V-belt as known in the art. This increase in the speed of the motor facilitates the increase in the pressure of the fluid from pumping because head pressure is proportional to the square of motor speed. In the embodiment shown in FIG. 1, a jacket 62 is bolted between the housing 44 and the motor 60 for enclosing the second magnet 56. Jacket 62 is provided with an inlet and outlet 64 and 66, respectively, for purging of fluids therethrough to prevent the formation of moisture to condense inside the jacket 62, which could freeze up the motor 60.

As a further preventative measure to the formation of such areas of moisture freezing, the fluid being pumped through pump 10 is circulated within the housing 44 as well. This interior circulation is accomplished by provision of a passage 68 in back plate 12 having a plug 70 positioned in a well 72 formed therein, the plug 70 having an orifice 74 therethrough. The orifice 74 and passage 68 allow high pressure fluid to pass from the volute formed inside the front half of housing 44' through the back plate 12 to the back half of housing 44" until sufficient back pressure builds behind back plate 12 to cause the fluid to return to the intake 46 of housing 44'. Return to the intake 46 is through the hollow shaft 14 and along the outside of the shaft 14 through the ball bearings 16 into the chamber 76 which connects through the hole 78 formed near the base of the blades 80 comprising impeller 18 (e.g., in the lower pressure portion of the volute).

Figure 2:
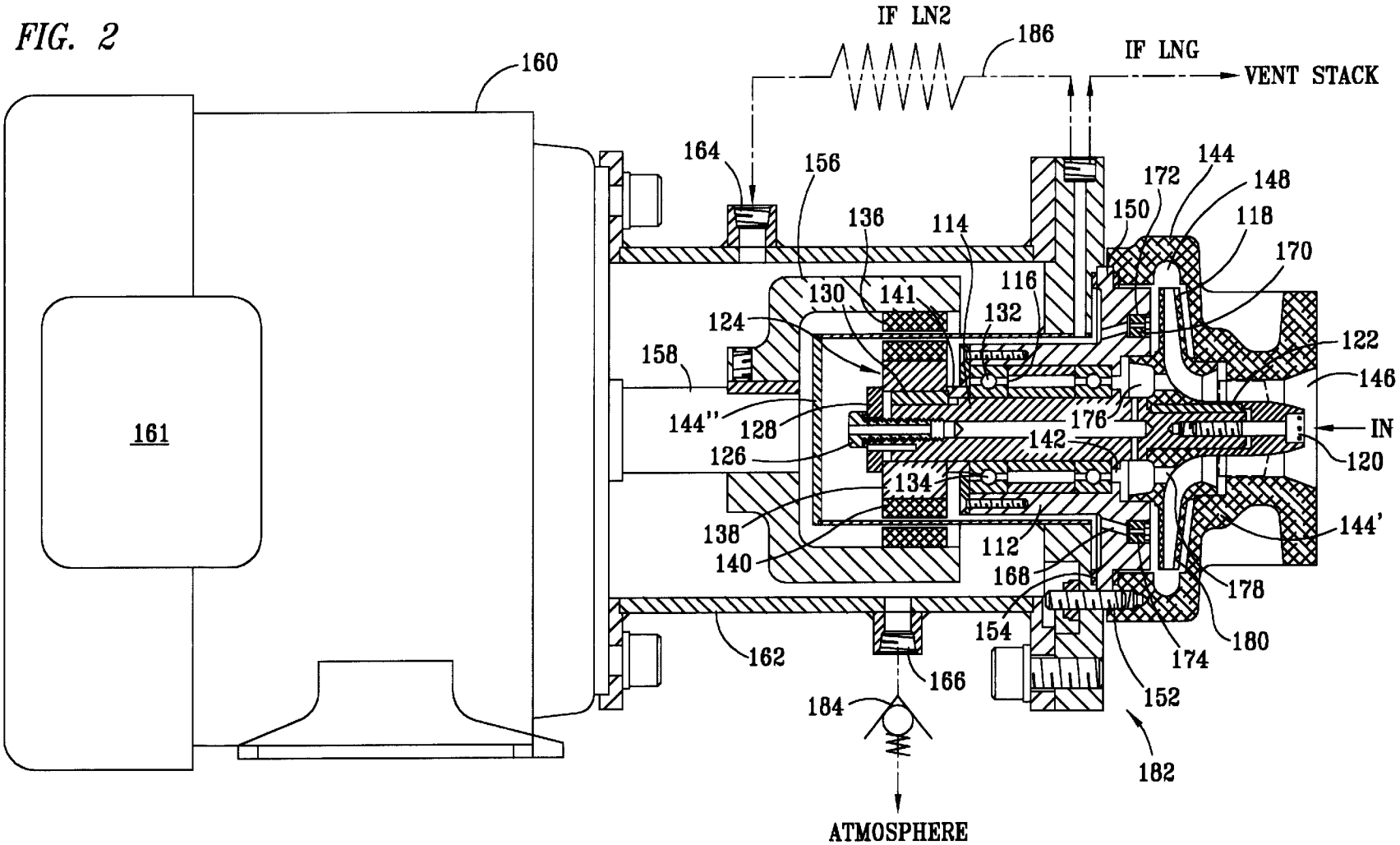
FIG. 2 is a sectional view similar to FIG. 1 of an alternative embodiment of the apparatus of the present invention.

Referring to FIG. 2, a second preferred embodiment of the pump of the present invention is indicated generally at reference numeral 182. In this second embodiment, all the component parts thereof are similar to those of the embodiment shown in FIG. 1 and are numbered with the same reference numeral preceded with a "1," e.g., impeller 18 in FIG. 1 is impeller 118 in FIG. 2. Pump 182 is particularly intended for use with those fluids such as liquid nitrogen which can be vented to the atmosphere and circulates the fluid being pumped in the same manner as does pump 10 in FIG. 1, but also provides a check valve 184 through which purging fluid is passed to the atmosphere through the back half of housing 144". The vented fluid can also be captured by a line 186 (shown in shadow lines to indicate that it is optional) and, which also acts as a vaporizer to assure that the vented fluid is converted into warm gas, circulated into the inlet 164 and through the jacket 162 for the purpose described above. If the fluid being pumped is LNG, the vented fluid can also be routed through a line to a stack (not shown) for burning.

Although described in terms of the above-illustrated preferred embodiments, those skilled in the art who have the benefit of this disclosure will recognize that many changes can be made to the component parts of the illustrated embodiments which do not change the manner in which these parts function to achieve results. Further, depending upon the working environment of the pump 62 and other factors known in the art, it may not be necessary to circulate purging fluid through the jacket 62 and certainly the fluid can be circulated through the jacket 62 in different routes. These and all other such changes are intended to fall within the spirit of the present invention as defined by the following claims.

What is claimed is:

1. A magnetic drive pump for use in pumping a low temperature fluid comprising:

a back plate having a rotatable shaft journaled therein; an impeller mounted to the first end of the shaft;

a first magnet mounted to the second end of the shaft and contained within a casing mounted to the shaft, the casing comprising a material having a coefficient of thermal expansion greater than the coefficient of thermal expansion of the material comprising said magnet; and said back plate being mounted within a housing having openings formed therein for intake and exhaust of a fluid to be pumped at very low temperature; and a second magnet positioned in close proximity to said housing for rotation therearound and adapted for mounting to the drive shaft of a motor for rotating said first magnet in the housing.

2. The pump of claim 1 additionally comprising a jacket mounted to said housing for enclosing said second magnet and having an inlet and an outlet formed therein for circulation of fluids therethrough.

3. The pump of claim 1 having an orifice formed in said back plate for circulation of fluid within said housing for preventing the formation of air pockets.

4. The pump of claim 3 additionally comprising an outlet formed in said housing for venting circulating fluid from said housing.

5. The pump of claim 4 additionally comprising a jacket mounted to said housing for enclosing said second magnet and having an inlet and an outlet formed therein for circulation of fluids therethrough.

6. The pump of claim 5 additionally comprising a connection between the outlet from said housing and the inlet of said jacket.

7. The pump of claim 1 additionally comprising a frequency inverter for increasing the speed of the motor rotating said first magnet.

8. A seal-less magnetic drive pump for pumping very low temperature fluid comprising:

a housing having an intake opening and an exhaust opening formed therein;

a back plate mounted within said housing; a rotatable shaft journaled in at least one ball bearing held in said backplate;

an impeller mounted to said first end of said rotatable shaft;

a casing mounted to said second end of said shaft for rotation therewith and comprising a casing material having a first coefficient of thermal expansion at very low temperatures;

a magnet mounted to said second end of said shaft within said casing, said magnet comprising a material sized for close tolerance fit within said casing at room temperature having a second coefficient of thermal expansion of said magnet less than said first coefficient of thermal expansion of said casing so that said casing is tighter on said magnet material at said very low temperature; and a second magnet positioned in close proximity to said housing to magnetically couple to said first magnet, said second magnet adapted for mounting to a motor for rotation of said second magnet by which said magnetically coupled first magnet is rotated.

9. The magnetic drive pump of claim 8 additionally comprising a motor and a frequency inverter for increasing the speed of said motor from about 3600 rpm to about 7200 rpm or higher.

* * * * *